US006431049B1

(12) United States Patent
Berg et al.

(10) Patent No.: US 6,431,049 B1
(45) Date of Patent: Aug. 13, 2002

(54) MANIFOLD FOR MAINTAINING A LATCH ACTUATOR UNDER PRESSURE AND ACCOMMODATING LEAKS

(75) Inventors: Gerald M. Berg, Lisbon; Thomas M. Sagaser, Bismark; Gaylen E. Halstensgaard, Milnor; Harold K. Beckstrom, Lisbon, all of ND (US); Michael J. Stoltenow, Mound; Timothy P. Sperry, Cambridge, both of MN (US)

(73) Assignees: Jem Technical Marketing Co., Inc., Long Lake, MN (US); Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/645,230

(22) Filed: Aug. 24, 2000

(51) Int. Cl.[7] ..... F15B 13/04
(52) U.S. Cl. ..... 91/420; 91/451; 137/596.2
(58) Field of Search ..... 91/420, 451; 92/86; 137/596.2

(56) References Cited

U.S. PATENT DOCUMENTS 4,126,293 A * 11/1978 Zeuner et al. ..... 92/52 X
4,211,256 A * 7/1980 Stutz, Jr. ..... 91/52
4,251,181 A 2/1981 Drott et al. ..... 414/723
4,597,322 A 7/1986 Garnjost et al. ..... 92/60
4,661,036 A 4/1987 Horsch ..... 414/686
4,663,866 A 5/1987 Karlsson et al. ..... 37/117.5
4,825,958 A 5/1989 Kelderman ..... 172/413
4,887,515 A 12/1989 Tabata ..... 92/80
5,049,027 A 9/1991 Morrison et al. ..... 414/723
5,110,254 A 5/1992 Aubrey ..... 414/723
5,147,173 A 9/1992 Fauber et al. ..... 414/723
5,286,050 A 2/1994 Stallings, Jr. et al. ..... 280/477
5,348,101 A 9/1994 Fox et al. ..... 172/2
5,410,947 A 5/1995 Garnjost ..... 92/80
5,562,165 A 10/1996 Janelle et al. ..... 172/4
5,562,397 A 10/1996 Albright ..... 414/723
5,727,442 A 3/1998 Wimmer ..... 91/42

* cited by examiner

*Primary Examiner*—Gerald A. Michalsky
(74) *Attorney, Agent, or Firm*—Westman, Champlin & Kelly, P.A.

(57) ABSTRACT

A double acting actuator is used for operating a pair of latches, and is controlled through a manifold that will permit a base end of the actuator to remain under pressure, and accommodate valve and piston leakage by connecting the rod end of the actuator to drain through a small orifice. The manifold additionally has relief valves for providing different pressures for the rod and base ends of the actuator, and a flow divider that provides a low flow to the actuator while the main flow from a pump is used for other hydraulic components.

8 Claims, 2 Drawing Sheets

MANIFOLD FOR MAINTAINING A LATCH ACTUATOR UNDER PRESSURE AND ACCOMMODATING LEAKS

BACKGROUND OF THE INVENTION

The present invention relates to a hydraulic manifold for controlling hydraulic fluid to a hydraulic actuator for holding a latch in position and which is maintained under pressure so that the latch is held positively in position. Leakage in valves and past pistons of double acting actuators is almost impossible to stop, and the present manifold will accommodate such leakage while maintaining differential pressure on the piston of the actuator.

Power actuators used in connection with various attachment devices have been known. U.S. Pat. No. 5,562,397 shows an electric power actuator for an attachment plate, wherein the actuator is connected between latch members and upon extension will move latches into a latching position. The latches are maintained in this position for reliable operation of the device.

When a hydraulic cylinder or actuator is used in place of the electric actuator, it is desirable to maintain a pressure on the base end, to avoid releasing the latches unintentionally. If pressure is maintained on one side of a piston of a double acting actuator, leakage to the low pressure side can occur in the valve block and across the piston, and the actuator can drift and get to a point where the pressures on opposite sides of the pistons are equalized.

Various locking cylinders for coupling attachments onto implements have been advanced in the past, and also leakage of hydraulic fluids in a seal assembly have been corrected. The present invention finds use where there is a hydraulic actuator which is to be maintained in a locked position with pressure on one side of the piston.

SUMMARY OF THE INVENTION

The present invention relates to a manifold for providing hydraulic fluid under pressure to a latching double acting actuator, which will accommodate leakage to a low pressure side of the piston and valve while pressure is maintained on the opposite side of the piston to insure that the actuator remains in the locking position. The leakage can occur across the control valve used as well as across the piston.

The manifold has a logic valve to provide a reduced flow to the latching actuator, and provides for different fluid pressures to opposite sides of the piston so a higher pressure can be used for releasing the latch members, which may require greater force, than the pressure used for locking the latch members.

One specific application is in a quick attachment for skid steer loaders, such as that using two wedge type latch bars that are operated with a power actuator that is connected between bell crank type operator handles. The handles can remain in place to provide an indication of the position of the latch bars without interfering with the double acting actuator operation.

The hydraulic manifold is preferably mounted directly in the outlet of the hydraulic pump used from the power source on a skid steer loader. In order to avoid draft or other problems caused by leakage from high pressure to low pressure regions when the base end of the actuator is under pressure, the hydraulic line connected from the valve to the rod end of the actuator, that is to the chamber on the rod side of the piston, is connected with a branch line or passage to drain or tank through an orifice that restricts the flow, so small volumes of oil from the rod end line will bleed back to drain. The orifice is small enough so the actuator can operate when the rod end is provided with flow under pressure when the valve is shifted to retract the rod.

The manifold provides for accommodating leakage when a double acting actuator is maintained under pressure on one end of the actuator and on one side of the piston while permitting a slow, low flow drain from the lines connected to the other side of the piston as may be necessary to accommodate leakage past the piston and valve from the pressure side.

DETAILED DESCRIPTION OF THE ILLUSTRATIVE EMBODIMENTS

The latch construction and actuator assembly positioning with which the present invention is used is shown in U.S. Pat. No. 5,562,397, and the specification is incorporated herein by reference. U.S. Pat. No. 5,562,397 shows an electric actuator, while the present device has a hydraulic actuator mounted in the same position relative to the latching levers and latch bars.

Figure 1:
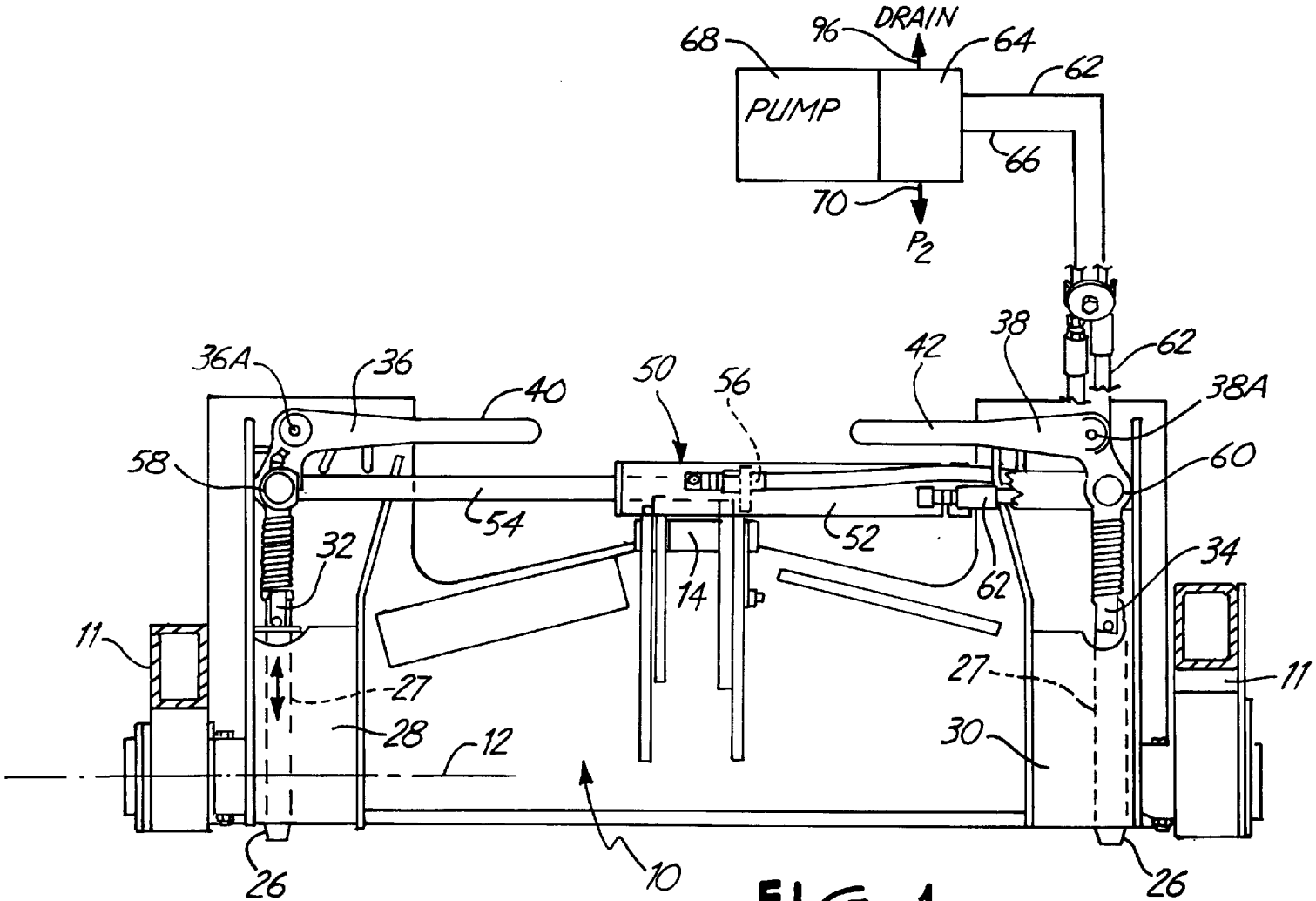
FIG. 1 is a rear view of a latching actuator used in connection with a quick attachment plate on a skid steer loader and controlled through the use of a manifold made according to the present invention.

In FIG. 1, a quick attachment plate indicated generally at 10 is used on a skid steer loader, and the loader has lift arms. shown fragmentarily at 11 that attach to plate 10 with pins. The attachment plate 10 is pivoted for tilting about the pins on an axis 12 through the use of an extendible and retractable rod of an actuator on a loader that connects to a pin 14 in the center of the attachment plate. The attachment plate 10 is utilized for attaching accessory implements to a skid steer loader.

The implement has mating parts that fit onto the attachment plate and which include receptacles or openings for receiving movable wedge end latch bars. The wedge ends 26 of the latch bars 27 are shown protruding below the attachment plate 10. The ends 26 will extend into receptacles on an attachment. These latch bars 27 are slidably guided in suitable guides indicated at 28 and 30 on opposite sides of the attachment plate. The latch bars 27 are pivotally connected to spring loaded links 32 and 34 on the respective sides of the attachment plate. The upper ends of the links 32 and 34 are pivotally connected to bell crank type levers 36 and 38, respectively, that are pivotally mounted as at 36A and 38A, to the attachment plate. The levers have hand grips 40 and 42 at the outer ends thereof so that the levers can be manually operated.

When the levers 36 and 38 are in the position shown in FIG. 1, the latch bars 27 are latched, and when the levers 36 and 38 pivot so that the handles extend upwardly, the latch bars 27 are pulled up so the wedge ends 26 are retracted and unlatched to permit the implement to be released.

A power hydraulic actuator indicated generally at 50 is provided to operate the latch bars 27 by pivoting the levers 36 and 38. The actuator 50 includes an outer cylinder 52, and a rod 54, which is connected to an internal piston shown in dotted lines at 56. The rod 54 has a rod end that is connected to a pivot 58 on the lever 36, and the base end of the actuator cylinder 52 is connected to a pivot 60 on the lever 38. The pivots 58 and 60 are also the pivots where the links 32 and 34 connect to the respective lever.

It can be seen in FIG. 1, that the rod 54 is extended, and the latch bars 27 are extended so the ends 26 extend out. The horizontal position of the handles 40 and 42 indicates that the latches are latched.

The actuator 52,is a double acting hydraulic actuator and pressure on one side of the piston 56 will cause the actuator rod 54 to extend, and pressure on the rod end will cause the actuator rod 54 to retract. The unlatching of the implement is by retracting the rod 54, that, is providing pressure to the rod. end of the cylinder 52. Locking the latches is accomplished by providing pressure to the base end of the cylinder 52.

The base end of the cylinder 52 is connected through a line 62 to a manifold made according to the present invention and indicated at 64. The rod end of the cylinder is connected with a line 66 to a different port on the same manifold. The manifold 64 can be mounted directly onto a pump shown at 68, and thus a compact assembly is made. The pump 68 provides hydraulic fluid flow under pressure. A separate line 70 leads to other components on the skid steer loader or to an implement that is to be operated.

Figure 2:
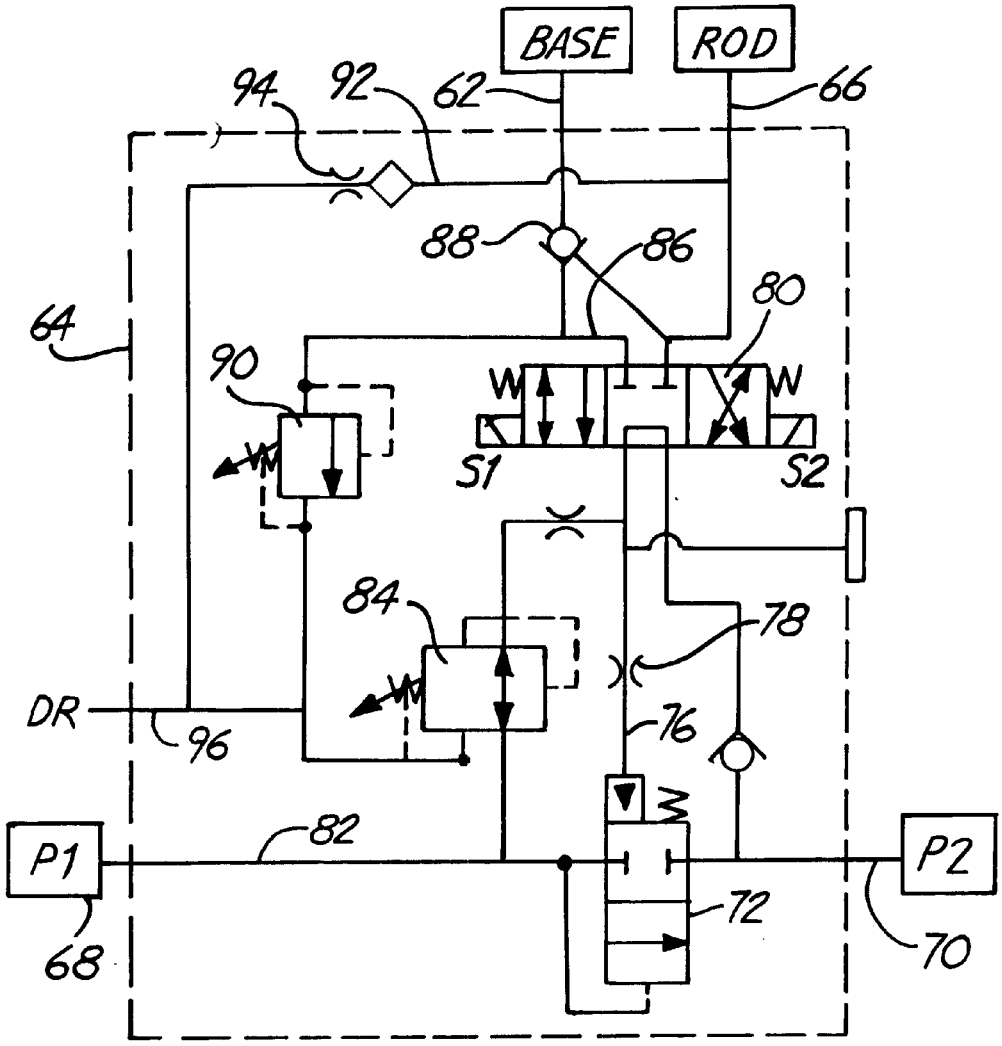
FIG. 2 is a schematic representation of the hydraulic circuit used with the manifold of the present invention.

In order to maintain pressure on the base end of the cylinder, without running into problems because of leakage from the valve to the rod end of the cylinder or leakage across the piston 56, which would tend to cause a balancing of pressures and drift of the position of the piston and rod, the manifold assembly includes features that are illustrated in FIG. 2.

FIG. 2 is a schematic representation of the manifold. The manifold block 64 is illustrated in dashed lines in FIG. 2. The pump 68 is connected at port P1 to a flow divider or logic valve 72 that will divert approximately one gallon per minute of pump flow to operate the actuator 50. The balance of the flow from the pump 68 is discharged along the line 70. The term "line" includes internal passageways in the manifold block 64, as well as external hydraulic hoses. A steady flow volume at pump pressure is provided to the other components on the skid steer loader or the implement attached to the quick attachment plate.

The logic valve 72 is a standard valve arrangement that provides one gallon per minute along an output line or passage 76 through an orifice 78 to a four-way solenoid valve 80. The line 82 from the pump is connected to a relief valve 84, that provides a pressure relief at approximately 2,000 psi, and this relief valve is also connected to the line 76, so that the maximum pressure that can be provided to the output of the valve 80 is 2,000 psi. The solenoid valve is controlled remotely in a desired manner.

On the output side of the four-way solenoid valve 80, a line 86 is connected to line 62 and thus to the base end of the actuator 50. The line 62 has a pilot operated check valve 88 therein, which receives a pilot pressure from the rod end line 66 before it will open. Additionally, however, the line 86 is branched with the line 62 and is connected to a lower pressure relief valve 90, which is set at approximately 1,200 psi, so that the maximum pressure that can be exerted on the base end of the actuator 50 is, as shown, 1,200 psi. When the four-way solenoid valve is shifted to subject the rod end of actuator 50 to pressure, the maximum pressure will be 2,000 psi. Many times the force necessary to release the latch bars is greater than that needed to latch the unit because of binding with a mounted implement. Further, the reduced pressure of 1,200 psi on the base of actuator 50 is low enough so that if there is some misalignment between the attachment plate and the implement, the parts will not be bent out of shape. The operator can properly align the parts and have the parts latch together without using higher pressure.

In order to accommodate leakage through the four-way valve 80, and/or across the piston in the actuator, the line 66 to the rod end of the actuator has a branch line 92 connected thereto that has an orifice 94 in it, line 92 leads to the tank or drain line 96. The orifice 94 lets low flow from leakage bleed back to the drain or tank but is small enough so that when the valve 80 is shifted to provide pump pressure to the rod end, pressure will build up to the full relief valve pressure, at the selected flow of one gallon per minute. The leakage volume is low so the rod end will be connected to drain during leakage so that pressure can be maintained on the base end of the piston and the rod end will be essentially at drain pressure or tank pressure.

It is apparent that the manifold can be used for any actuator or hydraulic circuit where a pressure is to be maintained on one side of a piston or movable element, without causing balancing of pressures by leakage of the valve, or the piston itself.

The present invention provides the non-active end of a double acting actuator with a connection to drain through a small orifice so that under low flows the low pressure side of the system will not become pressurized or drift, but yet when the non-active end is to be utilized for operating an element, it will carry pressure. Additionally, the manifold provides for two different pressures between a first end of an actuator and a second end of an actuator for applying different forces in the opposite direction of actuation.

Although the present invention has been described with reference to preferred embodiments, workers skilled in the art will recognize that changes may be made in form and detail without departing from the spirit and scope of the invention.

What is claimed is:

1. A hydraulic manifold for operating a double acting actuator, including a drain passage, a pressure passage, and a valve for selectively connecting the pressure passage to a first end of the actuator, a second end of the actuator being connected to the drain passage, a flow restriction device in the drain passage for restricting flow from the second end of the actuator and a pilot operated check valve connected to the first end of the actuator and preventing flow from the first end until pressure is provided to the second end of the actuator.

2. The manifold of claim 1 including a pump, a connection to said pump for providing hydraulic fluid under pressure, and a flow diverter valve for diverting a selected amount of flow from the pump to the valve through the pressure passage.

3. The manifold of claim 2 and a first relief valve connected to the pressure passage for providing a relief pressure in the pressure passage at a first pressure level, and a second relief valve connected to the first end of the cylinder, the second relief valve being set at a pressure level less than the relief pressure of the first relief valve.

4. A manifold for controlling hydraulic flow to a double acting actuator used operating a latch, said actuator comprising a cylinder and a rod moved by an internal piston, the cylinder being connected to actuate a latch, one end of the cylinder open to the piston being maintained under pressure to hold the latch in place, the manifold comprising a four-way valve for directing fluid under pressure from a pressure line selectively to the one end or to a second end of the double acting actuator, a check valve for preventing flow from the one end until pressure is provided at the second end, a drain line section connected to the second end, and an orifice in the drain line section that restricts flow from the second end, but permits low flows to drain.

5. The manifold of claim 4 including a first relief valve in the manifold for providing a first relief pressure to the four-way valve, and a second relief valve providing a second lower relief pressure connected to the one end of the cylinder.

6. The manifold of claim 4 including a pump to provide the fluid under pressure, and a flow divider valve regulating flow from the pump to provide a desired volume of flow to the four-way valve.

7. The manifold of claim 4 wherein the actuator is connected to operate a pair of latches, the cylinder having a base end connected to a first latch and the rod being connected to a second latch.

8. A hydraulic manifold for operating a double acting actuator comprising a cylinder and an actuator rod moved by an internal piston in the cylinder, the actuator rod being adapted to be connected to a member, the manifold including a drain passage, a pressure passage, and a valve for selectively connecting the pressure passage to a first end of the actuator for operating the actuator and maintaining the pressure on the first end of the actuator for selected periods of time, a second end of the actuator being connected to the drain passage, a flow restriction device in the drain passage for restricting flow from the second end of the actuator to provide for a drain for leakage from the second end of the actuator during the selected periods of time and a pilot operated check valve connected to the first end of the actuator and preventing flow from the first end until pressure from the pressure passage is provided to the second end of the actuator.

* * * * *